US006312858B1

(12) United States Patent
Yacobucci et al.

(10) Patent No.: US 6,312,858 B1
(45) Date of Patent: Nov. 6, 2001

(54) PROTECTIVE POLYCARBONATE-POLYURETHANE OVERCOAT FOR IMAGE RECORDING ELEMENTS

(75) Inventors: Paul D. Yacobucci; Hwei-Ling Yau; Catherine A. Falkner, all of Rochester; Wendy S. Krzemien, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,730

(22) Filed: Dec. 22, 2000

(51) Int. Cl.[7] ..... G03C 1/76; G03C 11/08; G03C 11/10; G03G 8/00; B41J 2/01

(52) U.S. Cl. ..... 430/17; 430/18; 430/97; 430/432; 430/531; 430/961; 347/105

(58) Field of Search ..... 430/531, 961, 430/18, 17, 97, 432; 347/105

(56) References Cited

U.S. PATENT DOCUMENTS

| | | | |
|---|---|---|---|
| 2,719,791 | 10/1955 | Land | 430/248 |
| 5,376,434 | 12/1994 | Ogawa et al. | 430/935 |
| 5,447,832 | 9/1995 | Wang et al. | 430/523 |
| 5,875,370 | 2/1999 | Patton et al. | 396/606 |
| 5,905,924 | 5/1999 | Patton et al. | 396/614 |
| 5,952,130 | 9/1999 | Yau et al. | 430/18 |
| 5,984,539 | 11/1999 | Patton et al. | 396/604 |
| 6,087,051 | 7/2000 | Shoji et al. | 430/531 |

OTHER PUBLICATIONS

Yau et al., "Protecting Layer for Image Recording Materials", U.S. Serial No. 09/354,209, (Attorney Docket No. 79582/D–W), filed Jul. 15, 1999.

*Primary Examiner*—Richard L. Schilling
(74) *Attorney, Agent, or Firm*—Chris P. Konkol

(57) ABSTRACT

The present invention relates to imaging elements, including photographic elements and ink-jet recording media, having a protective overcoat that resists fingerprints, common stains, and spills. More particularly, the protective overcoat comprises a polycarbonate-containing polyurethane polymer having a $T_g$ of 0 to 70° C. and a molecular weight of 15,000 to 200,000, wherein the amount of polycarbonate, based on the total weight of the polymer, is at least 20 percent.

19 Claims, No Drawings

PROTECTIVE POLYCARBONATE-POLYURETHANE OVERCOAT FOR IMAGE RECORDING ELEMENTS

FIELD OF THE INVENTION

The present invention relates to an improved protective overcoat for to image recording materials which overcoat provides excellent scratch, fingerprint, and water resistance. In particular, the protective overcoat comprises a selected polycarbonate-polyurethane material.

BACKGROUND OF THE INVENTION

Gelatin or other hydrophilic polymers are commonly used as binders in image recording materials such as silver-based photographic materials and ink-jet receivers. These products are known to be swellable when in contact with water. The swelling property is essential in order to accomplish photographic processing chemistry or to absorb ink to generate images in the final product. However, the same properly also inhibits end users from fully enjoying the imaged product. It is worrisome that, during handling, the imaged product is liable to damage from spilled drinks, fingerprints, and the like.

Various kinds of processes for applying protective overcoats onto image recording processes are known. Teachings on various methods and apparatus for applying a controlled amount of overcoat material onto silver-based photographic materials during photographic processing have been disclosed, for example, in U.S. Pat. No. 5,984,539, U.S. Pat. No. 5,905,924, U.S. Pat. No. 5,875,370, and U.S. Pat. No. 6,087,051. It would be advantageous to implement overcoat technology, including material compositions, in currently existing photofinishing systems and laboratories with minimal or no changes. The temperature and residence time of photographic materials in the drying section of photofinishing trade equipment typically vary from 50° C. to 70° C. and from 30 seconds to 2.5 minutes. (The actual temperature of an image recording material during drying is lower than the temperature set for the dryer due to the evaporation of water.) High temperatures or fusing steps are not normally used in photoprocessing and would involve an additional expense and inconvenience if required to apply an overcoat composition to an imaged element.

U.S. Pat. No. 2,719,791 describes the use of an aqueous dispersion of an organic plastic material, which yields a water impermeable coating on drying. However, it is known that when dispersions of low Tg material (Tg<25° C.) are used to obtain a water resistant protective coating, the surface of the protective coating has an undesirable tacky characteristic. In customer's hands, such a coating on an image recording element can degrade due to print blocking, fingerprinting, dust attraction, and high scratch propensity. On the other hand, when dispersions of high Tg materials (Tg>25° C.) are used, it is difficult or impossible to form a continuous water resistance layer on the prints under the drying condition described above.

U.S. Pat. No. 5,376,434 describes the use of at least two resins in the protective overcoat layer of a photographic print, at least one first resin having a glass transition temperature (Tg) of not less than 80° C., and at least one second resin having a Tg of 0° C. to 30° C., wherein an arithmetic mean of the glass transition temperatures of said first resin and said second resin is 30° C. to 70° C. The patent teaches the use of the high Tg resin to reduce the stickiness of the overcoat due to the low Tg material.

U.S. Pat. No. Patent 5,447,832 describes coating compositions for imaging elements comprising aqueous-based mixtures of lower Tg, film-forming polymeric particles and higher-Tg, non-film-forming polymeric particles. The film-forming particles provide continuous film formation and the non-film-forming particles comprise glassy polymers to provide resistance to tackiness, blocking, ferrotyping, abrasion and scratching.

While recognizing the above-mentioned benefits of two-component aqueous dispersions cited in U.S. Pat. Nos. 5,376,434 and 5,447,832, U.S. Pat. No. 5,952,130 further disclosed preferred substituents on the high and low Tg components in two-latex formulations in order to obtain improved fingerprint resistance. This patent discloses an overcoat comprising a first water-insoluble polymer having a Tg less than 25° C. (film-forming) and a second water insoluble polymer having a Tg greater than 25° C. (non-film forming), wherein one or the other of the two polymers comprise 20–100 weight percent of a monomer having a formula in which a substituent is Cl, F, or CN. Examples of such monomers are acrylonitrile, vinylidene chloride, tetrafluoroethylene, and methaciylonitlile.

U.S. Ser. No. 09/354,209 disclosed a low Tg polymer that fulfills the requirements of film formation, high gloss, excellent dry and wet scratch resistance, water resistance, oil and fingerprint resistance, and low tackiness without the use of a high Tg polymer latex. The polymer latex of this invention comprises 75% to 100%, preferably 80% to 95%, of the ethylenically unsaturated monomers of a certain formula wherein a substituent X is selected from the group consisting of —Cl, —F, or —CN, such as vinylidene chloride or acrylonitrile. A disclosed advantage of this coating is its ability to form a coating film at a modest drying temperature without being tacky on handling. The material composition is a colloidal dispersion of water insoluble polymeric materials having a Tg not more than 30° C. Preferred monomers are acrylonitrile, methacrylonitrile, vinylidene chloride, vinylidene fluoride, vinylidene cyanide, vinyl chloride, vinyl fluoride, tetrafluoroethylene, etc.

Materials described in U.S. Pat. No. 5,952,130 and U.S. Ser. No. 09/354,209 provide excellent protection to imaging materials compared to those described in U.S. Pat. Nos. 5,376,434 and 5,447,832 in terms of fingerprint-resistance, However, they have a problem with respect to image discolorization due to the de-hydrochlorination of the vinylidene chloride comonomer. This phenomenum is especially noticeable in the low image density area of the image recording element. Therefore, there is a need to identify a new class of materials that does not discolorize while maintaining equivalent fingerprint resistance.

U.S. Pat. No. 6,087,051 discloses the use of polyurethane resins containing a polycarbonate expressed by the general formula of —(O—R—O—CO)—, where R is a divalent group, for forming a protective coating layer for information recording materials. The protective coating layer was described as glossy and having excellent water and fingerprint resistance. However, the materials exemplified in the examples of this patent employ a system of coating involving relatively high drying temperatures.

In view of the above, there is a need for overcoat materials that provide good film formation during coating and drying, but which provide good properties in the final coating. The overcoat material should not discolorize while maintaining equivalent water, scratch, and fingerprint resistance. It would be desirable for such a coating to be applied to an image recording element under advantageous process conditions, such that minimal or no changes to existing photofinishing systems are necessary.

SUMMARY OF THE INVENTION

The present invention involves an aqueous overcoat composition for an image recording element. It has been found that the presence of a polycarbonate-containing polyurethane polymer having a weight average molecular weight above 15,000 and below 200,000 provides fulfills the requirements of film formation, high gloss, excellent durability to dry and wet scratches, and excellent resistance to water, oil, and fingerprints, without image discoloration on long-term keeping. The present invention is, therefore, able to prevent original image quality in an image recording element from being destroyed due to handling. Advantageously, the composition can be applied in a coating operation that employs common drying conditions. The term image recording element includes imaged photographic prints, ink-jet prints, thermal dye-transfer prints, and electrophotographic prints.

Preferably, the polycarbonate-containing polyurethane polymers also have a Tg between 30° C. to 70° C. In one embodiment of the present invention, the polycarbonate-polyurethane polymer can be a combined with a second polymeric material or binder, including another, different polyurethane. Optionally, the present invention may comprise a combination of at least one aqueous dispersible polycarbonate-polyurethane, as described above, and at least one organic or inorganic material, in the form of particles, having a Tg greater than 70° C. and having average particle size between 5 nm and 100 nm to control other surface and physical characteristics of the protective layer, such as coefficient of friction, hardness, stickiness, and the like.

DETAILED DESCRIPTION OF THE PREFERRED EMBODIMENTS

The present invention employs a class of aqueous dispersible polyurethanes composed of at least three basic starting materials: (1) a polycarbonate polyol, (2) a diisocyanate, and (3) a chain extender, for example, a glycol or diamine. The polycarbonate polyol is quite flexible and is commonly referred to as the soft segment. The diisocyanate and the chain extender form stiff oligourethane units refined to as hard segments. The ratio of the two-phase hard and soft segments is calculated on a weight percent, as described in more detail below. The polyurethane-containing compositions of the present invention are preferably free of volatile organic compounds or solvents and are applied as a coating to the image-recording product after image formation to form a water resistant, scratch resistant, and fingerprint resistant durable overcoat. Advantageously, as mentioned above, a feature of this invention that commonly assigned U.S. Pat. Nos. 5,376,434 and 5,477,832 do not possess is fingerprint resistance, and an improved feature of this invention, compared to commonly assigned U.S. Pat. No. 5,952,130 and U.S. Ser. No. 09/354,209 is non-discoloration on long-term keeping.

The polycarbonate-containing polyurethane polymer has a $T_g$ of 0 to 70° C., preferably 20 to 60° C., and molecular weight of 15,000 to 200,000, preferably 16,000 to 150,000, wherein the amount of polycarbonate, based on the total weight of the polymer is at least 20 percent, preferably 25 to 60 percent.

In one embodiment of the invention, the polymeric composition employed in the present invention can be represented by the following structure:

Structure I

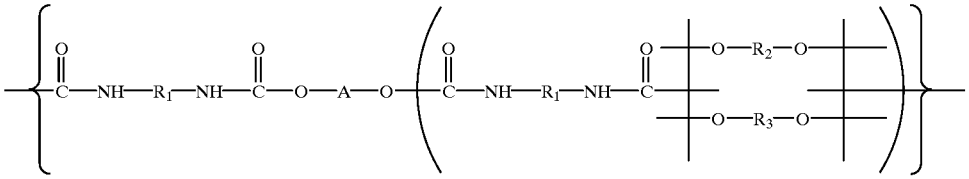

wherein the $R_1$ moiety is the central portion of the monomeric unit that is polymerization product of an diisocyanate monomer; A represents the central portion of a monomeric unit that is the polymerization product of one or more polyols, including at least one hydroxy-terminated polycarbonate having a molecular weight of 500 to 2500; $R_2$ represents the central portion of a monomeric unit that is the polymerization product of a diamine or diol chain extender having a molecular weight less than about 500; and optional $R_3$ is the central portion of an optional monomeric unit containing a phosphonate, carboxylate or sulfonate group. By the term "central portion" is meant the monomeric unit minus the terminal functional groups in the monomeric unit.

The hydroxy terminated polycarbonate can be selected from compounds disclosed in U.S. Pat. No. 6,087,051, the entirety of which is incorporated by reference. The A group in such polycarbonates can be based on the dihydroxy-containing aliphatic or aromatic compounds disclosed in columns 6 to 15 of said patent. At least 50%, preferably at least 80%, more preferably 95%, and most preferably 100% by weight of the one or more polyols forming the A group is a hydroxy terminated polycarbonate.

Optionally, in addition to the hydroxy-terminated polycarbonate, one or more other polyols may included such as (a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, 2,2-bis-(4-hydroxyphenyl)-propane, 2,2-bis-(4-hydroxyphenyl)-hexafluoropropane or the various isomeric bis-hydroxymethylcyclohexanes,(b) a polylactone such as polymers of 6-caprolactone and one of the above mentioned diols; and/or (c) a polyether such as a polymer or copolymer of styrene oxide, propylene oxide, ethylene oxide, tetrahydrofuran, butylene oxide or epichlorohydrin.

$R_1$ in Structure I above is preferably a hydrocarbon group having a valence of two, more preferably containing a substituted or unsubstituted alicyclic, aliphatic, or aromatic group, preferably represented by one or more of the following structures:

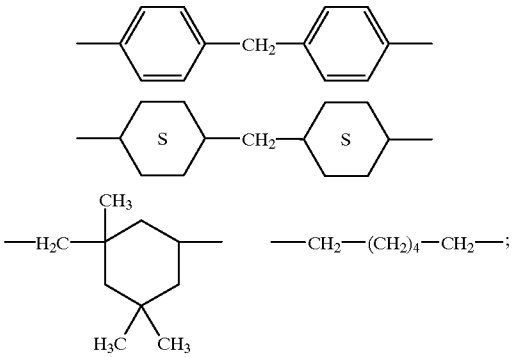

Preferably, $R_1$ is a non-aromatic, hydrocarbon group having 1 to 20 carbon atoms.

With respect to $R_2$, examples of suitable diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutylic hydrazide, bis-semi-carbazide, bis-hydrazide carbonic esters of glycols such as any of the glycols mentioned above. Suitable well-known diol chain extenders may also be any of the glycols or diols listed above for A or below for other polyurethanes.

The $R_3$ group in the optional chain extender is suitably present in the polycarbonate-containing polyurethane polymer in the amount of 0–20 percent by total weight of the polymer, preferably 2–10 percent by weight.

The polycarbonate-containing polyurethane polymer employed in the invention preferably has a Tg between about 0° C. and 70° C. and a weight average molecular above 15,000 and below 200,000. The soft segment in the preferred polyurethane is preferably a aliphatic polycarbonate with the molecular weight between 500 and 2500. A water-dispersible polyurethane employed in the invention may be prepared as generally described in "Polyurethane Handbook", Hanser Publishers, Munich Vienna, 1985.

The present invention can be a combination of more than one aqueous dispersible polyurethane described above. In a second polyurethane, less than 20% by weight of the polycarbonate segment A above may be used. Optionally, the present invention may be a combination of at least one aqueous dispersible polycarbonate-containing polyurethane polymer, as described above, and at least one additional organic or inorganic material, in the form of particles or a colloidal dispersion, having a Tg greater than 70° C. and having an average particle size between 5 nm and 100 nm (preferably 10 to 80 nm) in the amount of 0 to 40 percent, preferably 5 to 30 weight percent by weight of the dry coating, to control other surface and physical characteristics of the protective layer, such as coefficient of friction, hardness, stickiness, etc.

Preferred inorganic materials include colloidal silica, alumina, or titania. Colloidal dispersions of hydrophobic polymers having a Tg greater than 70° C. can be latexes or hydrophobic polymers of any composition that can be stabilized in a water-based medium. Such hydrophobic polymers are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl esters, vinyl heterocyclic compounds, styrenes, olefins and halogenated olefins, unsaturated acids and esters derived from them, unsaturated nitriles, vinyl alcohols, acrylamides and methacrylamides, vinyl ketones, multifunctional monomers, or copolymers formed from various combinations of these monomers. Such latex polymers can be prepared in aqueous media using well-known free-radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. The aqueous phase of the latex or colloidal dispersion of the invention may contain water-soluble polymers in order to control, for example, the viscosity and flow characteristics. The aqueous phase may also include surfactants of the cationic, anionic, zwitterionic or non-ionic types. Further listings of suitable monomers for addition type polymers are found in U.S. Pat. No. 5,594,047 incorporated herein by reference.

Preferred polymers are microgel particles as disclosed in U.S. Pat. No. 6,130,014, herein incorporated by reference in its entirety. Microgel particles are highly crosslinked polymer particles prepared by emulsion polymerization. Microgel particles typically comprise, based on the total weight of the monomer mixture, from about 5 to 50%, most preferably from about 5 to 20%, of a polymerizable carboxylic acid monomer and 2 to 20% of a difunctional crosslinking monomer, with the balance of the microgel composition comprising water-insoluble, ethylenically unsaturated or vinyl-type monomers.

The average particle size of the aqueous dispersible polycarbonate polyurethane of this invention can suitably be from 5 nm to 500 nm, preferably 5 nm to 200 nm. The dry laydown of the total materials on the surface of the image recording materials can be from 0.3 to 6.0 $g/m^2$.

Other components commonly used in image recording materials or photographic processing solutions, such as biocides, spreading aids (surfactants), lubricants and waxes can also be incorporated in the formulation as needed. The concentration of the formulation can be from 1% solids to 70% solids depending on the thickness of the protective layer one wishes to apply, the machine speed, the dryer efficiency and other factors that may affect the solution uptake by the image recording materials.

Waxes can be in the form of particles including dispersions of submicron size, from 0.01 $\mu$m to 1 $\mu$m wax particles such as those offered commercially as aqueous or non-aqueous dispersions of polyolefins, polypropylene, polyethylene, high density polyethylene, oxidized polyethylene, ethylene acrylic acid copolymers, microcrystalline wax, paraffin, and natural waxes such as carnauba wax, and aqueous dispersions of synthetic waxes from such companies as, but not limited to, Chemical Corporation of America (Chemcor), Inc., Michelman Inc., Shamrock Technologies Inc., Daniel Products Company. The dispersion may also contain dispersing aids such as polyethylene glycol.

Imaged photographic elements are among the image recording materials protected in accordance with this invention. Typically, the exemplified elements are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are preferred imaged elements for use in this invention.

The overcoat composition of the present invention can be applied to a image recording element following complete image formation by various known coating methods, including immersion of the image recording element in the coating composition, spraying of the image recording element with the coating composition, extrusion of the coating composition onto the element, or otherwise contacting and coating the image recording element with a film of the coating composition. An example of one method of applying the coating composition to the image recording element is disclosed in U.S. Pat. No. 6,087,051, hereby incorporated by reference in its entirety. In a photographic processing operation, the coating composition is applied after development and before drying. The overcoat is suitably applied at room temperature and subsequently heated in a drying step. The residence time in the drying section of photofinishing trade equipment typically vary from 30 seconds to 2.5 minutes, at rates up to and including 30 m/min or more. (The actual temperature of an image recording material during drying is lower than the temperature set for the dryer due to the evaporation of water.) High temperatures or fusing steps are not normally necessary when applying and drying the coating. In general, the overcoat composition is dried at an average temperature of 40° C. to 75° C., preferably 50 to 70° C., and preferably maintained at not more than 75° C. during the overall photoprocessing operation, and the overcoat need not be exposed to higher temperatures or fusing in order to provide good film forming and coalescence of polymeric particles.

The photographic elements in which the images to be protected are formed can have the structures and components shown in Research Disclosure 37038. Specific photographic elements can be those shown on pages 96–98 of Research Disclosure 37038 as Color Paper Elements 1 and 2. Such photographic elements, when imaged (developed) typically comprise at least one imaged layer comprising either silver (in the case of black and white images) and/or the reaction product of a developing agent and a dye-forming coupler (in the case of multicolored images), which imaged layer is superposed on a side of a support. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

Photographic images may also be produced using ink-jet printing. This printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat. No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5,563,634 of Masahiro et al. (Seiko Epson). Ink-jet inks may be either aqueous- or organic solvent-based. Aqueous inks are preferred for printing in home, office and retail environments. In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5,560,770 of Yatake (Seiko Epson), and U.S. Pat. No. 5,738,716 of Santilli et al. (Eastman Kodak). Ink-jet receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, water-fastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The present invention is illustrated by the following examples. Unless indicated otherwise, all molecular weight ranges herein are weight average molecular weights.

EXAMPLES

Characterizations of Polymeric Materials:

Glass Transition Temperature and Melting Temperature

Both glass transition temperature (Tg) and melting temperature (Tm) of the dry polymer material were determined by differential scanning calorimetry (DSC), using a heating rate of 20° C./minute. Tg is defined herein as the inflection point of the glass transition and Tm is defined herein as the peak of the melting transition.

Particle Size Measurement

All particles were characterized by Photon Correlation Spectroscopy (PCS) using a Zetasizer® Model DTS5100 manufactured by Malvern Instruments. Z-average particle sizes are reported.

Average Molecular Weight

The samples were analyzed by size-exclusion chromatography (SEC) in tetrahydrofuran using three Polymer Laboratories Plgel™mixed-C columns. The column set was calibrated with narrow-molecular-weight distribution polystyrene standards between 595 (log M=2.76) and 2170000 (log M=6.34) daltons. Weight average molecular weights (Mw) were reported.

Material Preparation:

Comparative polymers C1 to C8 are materials described in the prior art. In particular, C1 to C5 are styrene acrylic polymers, and C6 is an ethylacrylate/vinylidene chloride/itaconic acid polymer, C7 to C 17 are comparative polyurethane materials that are outside the composition of this invention for various reasons. For example, C7, C9 to C13, C15and C16 are non-polycarbonate polyurethanes, whereas C8, C14, and C17 are polycarbonate-containing polyurethanes outside the molecular weight range of the present invention.

H1 to H4 are hard particles used in combination with a polyurethane of this invention in a protective overcoat to modify the overcoat properties. Polymers P1 to P6 are materials of this invention. Polymeric materials used in the examples were prepared by the following synthetic methods.

C1 Styrene Acrylic Latex

Joncryl™ 2161, a water based styrene acrylic polymer latex, was purchased from SC Johnson Polymer at 48.5% solids, and used as received. Glass transition temperature was 90° C. (quoted from SC Johnson literature), average particle size obtained from PCS was 138 nm.

C2 Styrene Acrylic Latex

Joncryl™ 1603, a water based styrene acrylic polymer latex, was purchased from SC Johnson Polymer at 40% solids, and used as received. Glass transition temperatures were 25° C. and 80° C. (quoted from SC Johnson literature), average particle size obtained from PCS was 85 nm.

C3 Styrene Acrylic Latex

Joncryl™ HRC-1645, a water based styrene acrylic polymer latex, was purchased from SC Johnson Polymer at 40% solids, and used as received. Glass transition temperatures were 15° C. and 80° C. (quoted from SC Johnson literature), average particle size obtained from PCS was 163 nm.

C4 Styrene Acrylic Latex

Joncryl™SCX 2500, a water based styrene acrylic polymer latex, was purchased from SC Johnson Polymer at 43% solids, and used as received. Minimum film formation temperature was 8° C. (quoted from SC Johnson literature).

C5 Styrene Acrylic Latex

Joncryl™1908, a water based styrene acrylic polymer latex, was purchased from SC Johnson Polymer at 43% solids, and used as received. Minimum film formation temperature was greater than 80° C. (quoted from SC Johnson literature).

C6 Ethylacrylate/Vinylidene Chloride/Itaconic Acid (10/88/2)

To a 20-gallon, stainless-steel reactor added 44 kg of demineralized water. The system was purged for 15–30 minutes with nitrogen. The temperature was set at 15° C. and the stirrer was set at 150 RPM. The following were added to the reactor in order: 104.6 g potassium metabisulfite dissolved in 500 ml demineralized water, 421.9 g itaconic acid, 2109.5 g ethylacrylate, 18.56 kg of vinylidene chloride, 469 g of Dowfax™ 2EP rinsed in with 1 kg demineralized water, and 104.6 g potassium persulfate dissolved in 1.5 kg demineralized water. The reactor point and the vent were closed. The reactor was pressurized to 2 psi with nitrogen. The internal temperature was set to 40° C., and held there for 16–20 hours. The product was then cooled to 20° C., and the vacuum was broken with nitrogen. The product was filtered through cheesecloth. Glass transition temperature was 9° C. as measured by DSC, average particle size obtained from PCS was 77 nm.

C7 Superflex® 150 (Aqueous Polyurethane in U.S. Pat. No. 6,087,051)

This is a commercially available weak anionic colloidal dispersion of a crosslinked ester-ether aliphatic urethane elastomer sold by DKS (Daiichi Kogyo Seiyaku) International, Inc. Tokyo, Japan. The measured Tg is 34° C. and the molecular weight is higher than 1,000,000.

C8 Superflex® 410 (Aqueous Polyurethane in U.S. Pat. No. 6,087,051)

This is a commercially available weak anionic colloidal dispersion of a crosslinked carbonate type aliphatic urethane elastomer sold by DKS (Daiichi Kogyo Seiyaku) International, Inc. Tokyo, Japan. The measured Tg is 67° C. and the molecular weight is higher than 1,000,000.

C9 Comparison Polyurethane

In a 1 liter resin flask equipped with thermometer, stirrer, water condenser and a vacuum outlet, 18.90 g (0.018 mole) Pluracol® 1010 polyol (a polyethylene oxide, molecular weight of 1000, available from PPG) was placed in and dewatered under vacuum at 100° C. Release vacuum and at 40° C. add 4.29 g (0.032 mole) dimethylol propionic acid, 27.8 g (0.125 mole) isophorone diisocyanate, and 1.80 g dibutyltin dilaurate (catalyst) while stirring. Adjust temperature to 75° C. and maintain for about 4 hours to complete the reaction resulting in an intermediate containing approximately 3% free isocyanate. The free isocyanate content was monitored by Infrared spectroscopy of the absorption peak at 2240 wave number. Stir in 75 g tetrahydrofuran and stir at the same temperature for about 1 hour. Stir in 8.86 g (0.075 mole ) 1,6-hexanediol and maintain temperature until free isocyanate is substantially nil. Stir in a stoichiometric amount of potassium hydroxide based on dimethylol propionic acid, and maintain for additional 5 minutes. Mix with 600 g of distilled water under high shear to form a stable aqueous dispersion followed by evaporation of tetrahydrofuran. The weight ratio of hard segment to soft segment is 68/32. Mw as obtained by SEC was 9,180.

C10 Comparison Polyurethane

This material was prepared following the same procedure as for C9 except Terathane® 1000 (a poly(tetramethylene glycol), molecular weight of 1000, available from Dow Chemical was used in place of pluracol 1010, and 1,4-butanediol was used as the chain extender. The weight ratio of hard segment to soft segment was 66/34. Mw as obtained by SEC was 9,860.

C11 Comparison Polyurethane

This material was prepared following the same procedure as for C9 except Desmophen® (a poly(ethylene adipate) glycol, molecular weight of 2000, available from Bayer) was used in place of pluracol 1010, and neopentyl glycol was used as the chain extender. The weight ratio of hard segment to soft segment was 60/40. Mw as obtained by SEC was 6,460.

C12 Comparison Polyurethane

This material was prepared following the same procedure as for C9 except Tone® 0210 (a polycaprolactone polyol, molecular weight of 830, available from Union Carbide) was used in place of pluracol 1010, and neopentyl glycol was used as the chain extender. The weight ratio of hard segment to soft segment was 68/32. Mw as obtained by SEC was 6,300.

C13 Comparison Polyurethane

This material was prepared following the same procedure as for C9 except 4,4'-(hexafluoroisopropylidene) diphenol was used as the chain extender. The weight ratio of hard segment to soft segment was 65/35. Mw as obtained by SEC was 33,900.

C14 Comparison Polyurethane

This material was prepared following the same procedure as for C9 except PC-1733 (a polycarbonate polyol, molecular weight of 860, available from Stahl) was used in place of pluracol 1010 and 1,4-butanediol was used as the chain extender. The weight ratio of hard segment to soft segment was 67/33. Mw as obtained by SEC was 10,500.

C15 Comparison Polyurethane

This material was prepared following the same procedure as for C10, except the weight ratio of hard segment to soft segment was 58/42. Mw as obtained by SEC was 24,600.

C16 Comparison Polyurethane

This material was prepared following the same procedure as for C12 except 1,4-butanediol was used as the chain extender and the weight ratio of hard segment to soft segment was 58/42. Mw as obtained by SEC was 41,000.

C17 Comparison Polyurethane

This material was prepared following the same procedure as for C14 except the weight ratio of hard segment to soft segment was 53/47. Mw as obtained by SEC was 20,600.

H1 Hard Particles (80/10/10 ratio of methyl methacrylate/ethylene glycol dimethacrylate/ methacrylic acid)

1000 g deionized water and 11.25 g of sodium dodecyl sulfate (SDS) were charged to a 2-liter three-neck round-bottom flask equipped with mechanical stiller and nitrogen inlet. The solution was purged with nitrogen for 30 min and heated to 60° C. in a constant temperature bath. 180 g of methyl methacrylate, 22.5 g of methacrylic acid and 22.5 g of ethylene glycol dimethacrylate were added and stilled for three min. 22.5 g of 10% sodium persulfate and 10% sodium formaldehyde bisulfite were added to initiate the polymerization. Polymerization was continued for two hours at 60° C. 1 ml each of t-butyl hydroperoxide (10%) and sodium formaldehyde bisulfite (10%) were post-added and stilted for 30 min. The latex was cooled and filtered. Glass transition temperature was 144° C., average particle size was 45 nm, and % solids was 10%.

H2 Hard Particles (Ludox® AM Silica)

Is a commercially available aqueous colloidal dispersion of very small silica particles from DuPont. The average particle size is approximately 12 nm.

H3 Hard Particles (Ludox® TM Silica)

Is a commercially available aqueous colloidal dispersion of very small silica particles from DuPont. The average particle size is approximately 22 nm.

H4 Hard Particles (45/45/5/5 ratio of styrene/n-butyl methacrylate/ethylene glycol dimethacrylate/methacrylic acid) 1080 g of deionized water and 25 g of Rhodacal™ A-246L were charged to a 2-liter three-neck round- bottom flask equipped with mechanical stirrer and nitrogen inlet. The solution was purged with nitrogen for 30 min and heated to 80° C. in a constant temperature bath. 2 g of sodium persulfate was added and stirred for one min. A monomer emulsion comprising 25 g of Rhodacal™ A-246L, 2 g of sodium persulfate, 180 g of styrene, 180 g of n-butyl methacrylate, 20 g of methacrylic acid, and 20 g of ethylene glycol dimethacrylate was pumped in to the reactor over two hours. The polymerization was continued for one more hour. 2 ml each of t-butylhydroperoxide(10%) and sodium formaldehyde bisulfite(I10%) were post added and stirred 20 minutes. The latex was cooled and filtered. Glass transition temperature was 75° C., average particle size was 44 nm and % solids was 20.6%.

H5 Hard Particles (98/2 ratio of methyl methacrylate to 2-acrylamido-2-methyl-1-propanesufonic acid sodium salt)

400 g deionized water and 2.25 g of sodium dodecyl sulfate (SDS) were charged to a 1-liter three-neck round-bottom flask equipped with a mechanical stirrer and nitrogen inlet. The solution was purged with nitrogen for 30 min and heated to 80° C. in a constant temperature bath. 49 g of methyl methacrylate and 1 g of 2-acrylamido-2-methyl-1-propanesufonic acid(sodium salt) were added and stilled for three minutes. 4.5 g each of 10% sodium persulfate and 10% sodium metabisulfite were added to initiate the polymerization. Polymerization was continued for one hour and heated one more hour at 80° C. Temperature was reduced to 65–70° C. and 1 ml each of t-butyl hydroperoxide (10%) and sodium formaldehyde bisulfite (10%) were post-added. Latex was cooled and filtered. Glass transition temperature was 120° C., average particle size was 45 nm, and % solids was 10.1%.

P1 Polycarbonate-containing Polyurethane According to the Invention

This material was prepared following the same procedure as for C14, except the resulting material had Mw of 17,400 as obtained by SEC. The higher MW is obtained by extending the reaction time to 24 hours.

P2 Polycarbonate-containing Polyurethane According to the Invention

This material was prepared following the same procedure as for C14 except bisphenol A was used on as the chain extender at 8.2 wt % based on the entire hard segment composition. The weight ratio of hard segment to soft segment was 68/32. Mw as obtained by SEC was 25,800.

P3 Polycarbonate-containing Polyurethane According to the Invention

This material was prepared following the same procedure as for C14 having the weight ratio of hard segment to soft segment of 58/42, except the resulting material had an Mw of 26,100 as measured by SEC.

P4 Polycarbonate-containing Polyurethane According to the Invention

This material was prepared following the same procedure as for C14 except diethylene glycol was used as the chain extender at 6.5 wt % based on the entire hard segment composition. The weight ratio of hard segment to soft segment was 67/33, the resulting material had a Mw of 23,900 as measured by SEC.

P5 Polycarbonate-containing Polyurethane According to the Invention

This material was prepared following the same procedure as for P2 except Bisphenol A bis(2-hydroxyethyl)ether is used in place of Bisphenol A at 15 wt % of the hard segment. The weight ratio of hard segment to soft segment was 58/42, the resulting material had a Mw of 35,900 as measured by SEC.

P6 Polycarbonate-containing Polyurethane According to the Invention

This material was prepared following the same procedure as for P2 except Bisphenol A was used at 11.2 wt % of the hard segment. The weight ratio of hard segment to soft segment was 58/42, the resulting material had a Mw of 19,300.

Wax-1

Jonwax™26, an aqueous dispersion of high density polyethylene wax particles, was purchased from SC Johnson at 25% solids and used as received. The melting point of this wax was 130° C. and the average particle size was 58 nm.

Wax-2

ML160®, an aqueous dispersion of carnauba wax particles, was purchased from Michelman at 25% solids and used as received. The melting point of this wax was 88° C. and the average particle size was 109 nm.

Sample Preparation:

Kodak Edge 7 Ektacolor™paper was exposed with a step tablet wedge to three different colors (red, green and blue) on a Kodak® Automatic 312 Color Printer and processed by a HOPE® 3026 processor using RA-4 chemicals to provide cyan, magenta and yellow colors.

All samples were prepared by coating aqueous colloidal dispersions on the exposed/processed Kodak Edge 7 Ektacolor™ paper described above at 3.0 cc/sq.ft. with a dryer temperature of 140F. to simulate the photofinishing process. Surfactant FT-248® (available from Bayer) was used at the dry laydown of 1 mg per square foot respectively in all formulations to control the surface tension of the coating fluid. Waxes were used in formulations to control the friction characteristics of the protective overcoat surface.

Sample Testing:

Test for Water Resistance

Ponceau Red dye is known to stain gelatin through ionic interaction. Ponceau red dye solution was prepared by dissolving 1 gram of dye in 1000 grams mixture of acetic acid and water (5 parts: 95 palts). Samples were soaked in the dye solution for 5 minutes followed by a 30-second water rinse to removed excess dye solution on the coating surface, then air dried. A sample with a good water-resistant protective layer does not change in appearance by this test. Samples showed very dense red color if there was no protective overcoat applied to the surface or the formulation did not form a protective overcoat layer to provide the water resistance property.

Test for Durability on Wet Wiping

An approximately 0.2 cc Ponceau Red dye solution was placed on the sample surface of 1 cm-diameter area for 10 minutes. The liquid was then wiped up with Sturdi-Wipes paper towel with approx. 1000 grams weight applied on it Several phenomena were often observed.

A: no mark of surface scratches was observed.

B: very mild scratches on the protective overcoat layer were observed.

C: very severe scratches on the protective overcoat layer were observed.

D: protective overcoat layer was removed by wiping and Ponceau red dye penetrated into image layers to give a red mark.

A visual observation was recorded. "A" is most desirable and "B" is acceptable. A result of "C" or "D" is not acceptable at all.

Test for Dry Scratch Resistance

Each sample was rubbed with a dry paper towel for 40 passes under a pressure of 0.75 psi (500 grams over a 1.375 inch-diameter area). The scratches generated by the rubbing test were rated according to the description below. Ratings higher than 5 are desirable.

Scratch Resistance Ratings:

0 . . . Totally abraded/worn
1 . . . Dense scratches with associated haze band
2 . . . Numerous scratches with associated haze band
3 . . . Few scratches with associated haze band
4 . . . Dense, heavy scratches
5 . . . Numerous, heavy scratches
6 . . . Few, heavy scratches
7 . . . Dense, heavy scratches
8 . . . Numerous, light scratches
9 . . . Few, light scratches
10 . . . No visible damage Test for Fingerprint Resistance Thermaderm, a specially formulated mixture (see preparation below) to mimic fingerprint oil having the composition in Table 1 below , was applied to the surface of the protective overcoat by smearing with a finger at approx. 1 mg thermaderm over an area of 1 sq.cm. The sample was left for 24 hours in room condition (often 70F./50% RH) and then wiped with cotton cloth to clean up the surface. The test area was ranked according to the following phenomenon. The test was done in the high image density area for easier observation.

A: no mark of fingerprints was observed.

B: very mild/faint fingerprints on the protective overcoat layer was observed.

C: very obvious fingerprint mark by Thermaderm on the protective overcoat layer was observed.

D: protective overcoat layer was removed on wiping.

A ranking of "A" is most desirable, "B" is acceptable, "C" and "D" are not acceptable at all.

TABLE 1

| | Amount |
|---|---|
| Non-aqueous phase | |
| Corn oil | 78.96 grams |
| Mineral oil | 25.26 grams |
| Glycerin | 52.64 grams |
| Stearyl alcohol | 15.79 grams |
| Oleic acid | 63.16 grams |
| Sorbitan monooleate | 2.05 grams |
| Cetyl palmitate | 6.32 grams |
| Oleyl alcohol | 6.32 grams |
| Stearic acid | 31.58 grams |
| Lexemul ® AR Glyceryl Stearate (Inolex Chemical Co., Philadelphia, PA 19148) | 47.36 grams |
| Cholesterol | 9.47 grams |
| Methylparaben | 4.21 grams |
| Butyl paraben | 3.16 grams |
| Butylated hydroxytoluene | 0.21 grams |
| Butylated hydroxyanisole | 0.21 grams |
| Vitamin E acetate | 0.13 grains |
| Cetyl alcohol | 15.79 grams |
| Squalene | 15.79 grams |

TABLE 1-continued

| | Amount |
|---|---|
| Aqueous Phase | |
| Pegosperse ® 1750 MS-K Surfactant | 31.58 grams |
| Distilled water | 571.01 grams |

Ingredients were added in the order listed. The corn oil was carefully heated using a warm water bath to aid in the dissolution of the non-aqueous phase. The aqueous phase was warmed to aid in the dissolution of the Pegosperse®, an ethoxylated fatty acid sold by Glyco Chemicals, Inc. The aqueous phase was quickly added to the non-aqueous phase with vigorous agitation. The resultant suspension was then partially emulsified with an air powered Polytron® mixer for approximately 5 minutes. Complete emulsification was accomplished by processing through a Microfluidizer® mixer. After preparation, the material was stored in a tightly sealed container and kept frozen, removing a small quantity as needed for the tests.

Test for Thermal Yellowing of Protective Overcoat

This test was done on the area of sample where no image dye was formed (unexposed, white image area) for easier comparison. Samples with protective overcoat along with a comparison sample without overcoat were kept in a condition chamber of 75° C. and 50% RH for 4 weeks. Blue density of each sample before and after the test was measured by X-Rite® 820 densitometer in reflection status A mode. The density gain for the comparison sample without protective overcoat after the thermal incubation is attributed to the imaging layers, whilst the density gain for samples with protective overcoat after the test is contributed from both the imaging layers and the protective overcoat layer. The difference in density gain between a sample with protective overcoat and a comparison sample without protective overcoat is due to the thermal yellowing of the protective overcoat layer, which is reported in the Examples below.

Example 1

A variety of aqueous polyurethane dispersions, both according to the present invention and for comparison, were prepared. Their differences in composition and average molecular weight are tabulated in Table 2 below for reference.

TABLE 2

| Identification | Chain Extender | Soft segment | Weight % Soft Segment | Mw |
|---|---|---|---|---|
| Comparison C7 | Not available | Poly(ester-ether) | Not available | 1,000,000 (crosslinked) |
| Comparison C8 | Not available | Polycarbonate | Not available | >1,000,000 (crosslinked) |
| Comparison C9 | 1,6-Hexane-diol | Pluracol ® 1010 (polyethylene oxide, MW = 1000) | 32% | 9,180 |
| Comparison C10 | 1,4-Butanediol | Terathane ® 1000 (polytetra-methylene oxide, MW = 1000) | 34% | 6,460 |
| Comparison C11 | Neopentyl glycol | Desmophen ® 2000 (poly(ethylene adipate) glycol, MW = 2000) | 40% | 6,460 |

TABLE 2-continued

| Identification | Chain Extender | Soft segment | Weight % Soft Segment | Mw |
|---|---|---|---|---|
| Comparison C12 | Neopentyl glycol | Tone ® 0210 (polycaprolactone diol, MW = 830) | 32% | 6,300 |
| Comparison C13 | 4,4'-(hexa-fluoroiso-propyl-idene) diphenol | Pluracol ® 1010 (polyethylene oxide, MW = 1000) | 35% | 33,900 |
| Comparison C14 | 1,4-Butanediol | PC-1733 ® (polycarbonate diol, MW = 860) | 33% | 10,500 |
| Comparison C15 | 1,4-Butanediol | Terathane ® 1000 (polytetra-methylene oxide, MW = 1000) | 42% | 24,600 |
| Comparison C16 | 1,4-Butanediol | Tone ® 0210 (polycaprolactone diol, MW = 830) | 42% | 41,000 |
| P1 | 1,4-Butanediol | PC-1733 ® (polycarbonate diol, MW = 860) | 33% | 17,400 |
| P2 | 1,4-Butanediol and Bisphenol A | PC-1733 ® (polycarbonate diol, MW = 860) | 32% | 25,800 |

TABLE 2-continued

| Identification | Chain Extender | Soft segment | Weight % Soft Segment | Mw |
|---|---|---|---|---|
| P3 | 1,4-Butanediol | PC-1733 ® (polycarbonate diol, MW = 860) | 42% | 26,100 |
| P4 | 1,4-Butanediol and diethylene glycol | PC-1733 ® (polycarbonate diol, MW = 860) | 33% | 23,900 |
| P5 | 1,4-butanediol and Bisphenol A bis(2-hydroxy-ethyl)-ether | PC-1733 ® (polycarbonate diol, MW = 860) | 42% | 35,900 |
| P6 | 1,4-butanediol and Bisphenol A | PC-1733 ® (polycarbonate diol, MW = 860) | 42% | 19,300 |

A series of samples were prepared with the protective overcoat formulation described in Table 3.

TABLE 3

| Sample ID | Overcoat Description | Composition @ mg/ft$^2$ | Water Resistance | Wet Wipe Durability | Dry Scratch Durability | Fingerprint Resistance |
|---|---|---|---|---|---|---|
| Control CC-1 | Edge ® 7 without inventive overcoat | None | No | Very poor | 5 | C |
| CC-2 | similar to examples shown in U.S. Pat No. 5,376,434 | C1 @ 26<br>C2 @ 156<br>C3 @ 78<br>Wax-1 @ 39 | Yes | A | 8 | D |
| CC-3 | Similar to examples shown in U.S. Pat. No. 5,376,434 | C4 @ 180<br>C5 @ 80<br>Wax-1 @ 39 | Yes | A | 8 | C |
| CC-4 | Example shown in U.S. Pat. No. 5,952,130 | C6 @ 200<br>Wax-1 @ 10<br>Wax-2 @ 10 | Yes | A | 5 | A |
| CC-5 | Example shown in U.S. Pat. No. 6,130,014 | C6 @ 200<br>C21 @ 50<br>Wax-1 @ 7<br>Wax-2 @ 7 | Yes | A | 4 | A |
| CC-6 | Example in U.S. Pat. No. 6,087,051 | C7 @ 200 | Yes | A | 8 | C |
| CC-7 | Example in U.S. Pat. No. 6,087,051 | C8 @ 200 | Yes | C | 8 | C |
| CC-8 | Comparison example of polyurethane | C9 @ 200<br>Wax-1 @ 7<br>Wax-2 @ 7 | Yes | A | 5 | D |
| CC-9 | Comparison example of polyurethane | C10 @ 200<br>Wax-1 @ 7<br>Wax-2 @ 7 | Yes | B | 5 | D |
| CC-10 | Comparison example of polyurethane | C11 @ 200<br>Wax-1 @ 7<br>Wax-2 @ 7 | Yes | C | 5 | C |

TABLE 3-continued

| Sample ID | Overcoat Description | Composition @ mg/ft$^2$ | Water Resistance | Wet Wipe Durability | Dry Scratch Durability | Fingerprint Resistance |
|---|---|---|---|---|---|---|
| CC-11 | Comparison example of polyurethane | C12 @ 200<br>Wax-1 @ 7<br>Wax-2 @ 7 | Yes | B | 5 | D |
| CC-12 | Comparison example of polyurethane | C13 @ 200<br>Wax-1 @ 7<br>Wax-2 @ 7 | Yes | A | 5 | D |
| CC-13 | Comparison example of polyurethane | C15 @ 200<br>H1 @ 50<br>Wax-1 @ 5<br>Wax-2 @ 5 | Yes | A | 8 | D |
| CC-14 | Comparison example of polyurethane | C16 @ 200<br>H1 @ 50<br>Wax-1 @ 5<br>Wax-2 @ 5 | Yes | A | 5 | D |
| CC-15 | Comparison example of polyurethane | C14 @ 200<br>Wax-1 @ 5<br>Wax-2 @ 5 | Yes | B | 5 | B |
| PP-1 | Invention | P1 @ 200<br>Wax-2 @ 5 | Yes | A | 5 | A |
| PP-2 | Invention | P1 @ 200<br>H1 @ 50<br>Wax-1 @ 5<br>Wax-2 @ 5 | Yes | A | 5 | A |
| PP-3 | Invention | P1 @ 200<br>H5 @ 50<br>Wax-1 @ 5<br>Wax-2 @ 5 | Yes | A | 4 | A |
| PP-4 | Invention | P1 @ 200<br>H2 @ 15<br>Wax-1 @ 5<br>Wax-2 @ 5 | Yes | B | 6 | A |
| PP-5 | Invention | P1 @ 200<br>H3 @ 15<br>Wax-1 @ 5<br>Wax-2 @ 5 | Yes | B | 5 | A |
| PP-6 | Invention | P2 @ 200<br>H1 @ 50<br>Wax-1 @ 5<br>Wax-3 @ 5 | Yes | A | 5 | A |
| PP-7 | Invention | P3 @ 200<br>H1 @ 50<br>Wax-1 @ 5<br>Wax-3 @ 5 | Yes | A | 5 | A |
| PP-8 | Invention | P4 @ 200<br>H1 @ 50<br>Wax-1 @ 5<br>Wax-3 @ 5 | Yes | A | 5 | A |
| PP-9 | Invention | P5 @ 200<br>H1 @ 50<br>Wax-1 @ 5<br>Wax-3 @ 5 | Yes | A | 6 | A |
| PP-10 | Invention | P6 @ 200<br>H1 @ 50<br>Wax-1 @ 5<br>Wax-3 @ 5 | Yes | A | 6 | A |

As presented in Table 3, the Control sample CC-1 is Kodak Edge® 7 paper without a latex overcoat which, therefore, does not possess the improved water resistance nor fingerprint resistance.

Comparative samples CC-2 and CC-3 are similar to examples demonstrated in U.S. Pat. No. 5,376,434, which consists of at least two latices in the overcoat composition, one having Tg below 30° C. and one having Tg above 80° C. The introduction of the high Tg latex was needed to avoid the tackiness in high temperature condition. However, none of them have desirable fingerprint resistance. Comparative sample CC-4 was the reproduction of example from U.S. Pat. No. 5,952,130. Comparative sample C6 is a vinylidene chloride copolymer having Tg of 9° C. Comparative Sample CC-5 was a reproduction of example from U.S. Pat. No. 6,130,014, which contained a second latex having Tg higher than 30° C. in the overcoat. Both samples showed excellent water resistance, wet and dry scratch resistance, and fingerprint resistance.

Comparative samples CC-6 and CC-7 were the reproduction of examples described in U.S. Pat. No. 6,087,051. Even though polyurethane dispersions C7 and C8 were used as the protective overcoat, they do not provide fingerprint resistance property to the photographic prints. Due to the crosslinked structure and, thus, high molecular weight of these polyurethanes, poor coalescence resulted.

Comparative samples CC-8 to CC-14 were prepared from a variety of polyurethane dispersions in which the soft segments were not polycarbonate and, therefore, did not provide fingerprint resistance property, regardless of the very high average molecular weight for C13, C15 and C16.

Comparative sample CC-15 was prepared using a polyurethane C14 with identical composition to P1, except having lower average molecular weight, Mw=10,500. As shown by the test result in Table 3, the wet scratch resistance and the fingerprint resistance for sample PP-20 were degraded due to the lower molecular weight compared to PP-1.

Inventive sample PP-1 was prepared from polyurethane dispersion P1, which consists of polycarbonate as the soft segment, the %SS (soft segment) is 33%, and the average molecular weight Mw is 17,400. As shown in Table 2, this sample provide excellent fingerprint resistance properly in addition to the excellent durability to wet and dry scratches.

Inventive samples PP-2 to PP-5 were prepared similar to PP-1, except with the addition of hard particles H1, H2, H3 and H4 in the overcoat composition to modify the surface property of the protective overcoat. The composition of hard particles ranges from polymethyl methacrylate for H1 and H5 to colloidal silica particles for H2 and H3. As indicated by the test results, the addition of hard particles did not affect the fingerprint resistance property.

Samples PP-6 to PP-10 were additional samples prepared using other polyurethane dispersion according to the present invention. The compositions of P1 to P6 are different in the hard segment. However, they all consist of polycarbonate as the soft segment and their average molecular weights are all above 12,000. As shown in Table 2, samples PP-6 to PP-10 all possessed excellent durability to wet and dry scratches and to fingerprint, as did sample PP-1.

Example 2

Samples described in Example 1 that demonstrated satisfactory resistance to wet and dry scratches and fingerprint were further tested for thermal yellowing. The results are shown in Table 4 below.

TABLE 4

| Sample ID | Description | Overcoat Composition (@ mg/sq.ft.) | Fingerprint Resistance | Thermal yellowing of the protective overcoat layer |
|---|---|---|---|---|
| CC-1 | Edge ® 7 without inventive overcoat | None | C | Reference |
| CC-4 | Example shown in U.S. Ser. No. US09/354,209 | C6 @ 200<br>Wax-1 @ 10<br>Wax-2 @ 10 | A | +0.05 |
| CC-5 | Example shown in U.S. Pat. No. 6,130,014 | C6 @ 200<br>C21 @ 50<br>Wax-1 @ 7<br>Wax-2 @ 7 | A | +0.02 |
| PP-1 | Invention | P1 @ 200<br>Wax-2 @ 5 | A | +0.00 |
| PP-2 | Invention | P1 @ 200<br>H1 @ 50<br>Wax-1 @ 5<br>Wax-2 @ 5 | A | +0.00 |
| PP-3 | Invention | P1 @ 200<br>H5 @ 50<br>Wax-1 @ 5<br>Wax-2 @ 5 | A | +0.00 |
| PP-4 | Invention | P1 @ 200<br>H2 @ 15,<br>Wax-1 @ 5<br>Wax-2 @ 5 | A | +0.00 |
| PP-5 | Invention | P1 @ 200<br>H3 @ 15<br>Wax-1 @ 5<br>Wax-2 @ 5 | A | +0.00 |
| PP-6 | Invention | P2 @ 200<br>H1 @ 50<br>Wax-1 @ 5<br>Wax-3 @ 5 | A | +0.00 |
| PP-7 | Invention | P3 @ 200<br>H1 @ 50<br>Wax-1 @ 5<br>Wax-3 @ 5 | A | +0.00 |
| PP-8 | Invention | P4 @ 200<br>H1 @ 50<br>Wax-1 @ 5<br>Wax-3 @ 5 | A | +0.00 |
| PP-9 | Invention | P5 @ 200<br>H1 @ 50<br>Wax-1 @ 5<br>Wax-3 @ 5 | A | +0.00 |
| PP-10- | Invention | P6 @ 200<br>H1 @ 50<br>Wax-1 @ 5<br>Wax-3 @ 5 | A | +0.00 |

As shown in Table 4, the protective overcoat materials disclosed in prior application Ser. No. 09/354,209 and U.S. Pat. No. 6,130,014 exhibits undesirable thermal yellowing, while the protective overcoat of this invention does not.

The invention has been described in detail with particular reference to certain preferred embodiments thereof, but it will be understood that variations and modifications can be effected within the spirit and scope of the invention.

What is claimed is:

1. An imaged photographic element comprising:

a support;

at least one imaged layer comprising either silver and/or the reaction product of a developing agent and a dye-forming coupler, which imaged layer is superposed on a side of said support;

a protective overcoat, overlying said imaged layer, comprising a polycarbonate-containing polyurethane polymer having a $T_g$ of 0 to 70° C. and a molecular weight of 15,000 to 200,000, wherein the amount of polycarbonate, based on the total weight of the polymer, is at least 20 percent.

2. The imaged photographic element of claim 1 wherein the polycarbonate-containing polyurethane polymer is represented by the following structure:

Structure I

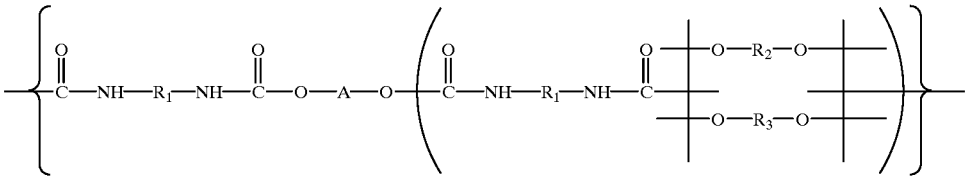

wherein $R_1$ is the central portion of a monomeric unit formed by the reaction of a diisocyanate monomer; A represents the central portion of a monomeric unit formed by the reaction of one or more polyols at least 50% by weight of which polyols is a hydroxy-terminated polycarbonate having a molecular weight of 500 to 2500; and $R_2$ is the central portion of a monomeric unit formed by the reaction of at least one chain extender having a molecular weight less than 500, and wherein $R_3$ is the central portion of an optional monomeric unit containing a phosphonate, carboxylate or sulfonate group.

3. The imaged photographic element of claim 2 wherein $R_1$ is a non-aromatic substituted or unsubstituted aliphatic or alicyclic group.

4. The imaged photographic element of claim 2 wherein $R_2$ is a diamine selected from the group consisting of ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine 2,6-diaminopyridine, 4,4'-diamino diphenylmethane, and adducts of diethylene triamine with acrylate or its hydrolyzed products.

5. The imaged photographic element of claim 1 wherein the overcoat further comprises a second polymer and/or inorganic material having a Tg above 70° C.

6. The imaged photographic element of claim 5 wherein the inorganic material is selected from the group consisting of colloidal silica, alumina, titania, and combinations thereof, and having a particle size of 5 to 100 nm.

7. The imaged photographic element of claim 5 wherein the second polymer is selected from the group consisting of polyurethanes, polyesters, polyamides, polyureas, polyethers, polycarbonates and polyacid anhydrides.

8. The imaged photographic element of claim 5 wherein the second polymer is formed from the polymerization of a reaction mixture comprising one or more vinyl-type monomers selected from the group consisting of allyl compounds, vinyl ethers, vinyl esters, vinyl heterocyclic compounds, styrenes, olefins, halogenated olefins, unsaturated acids, and esters derived from unsaturated acids, unsaturated nitriles, vinyl alcohols, acrylamides, methacrylamides, and vinyl ketones.

9. The imaged photographic element of claim 5 wherein the second polymer is a microgel.

10. The imaged photographic element of claim 1 wherein the overcoat further comprises one or more addenda selected from the group consisting of UV absorbers, surfactants, emulsifiers, coating aids, lubricants, matte particles, rheology modifiers, speed-control dyes, crosslinking agents for gelatin, antifoggants, inorganic fillers, pigments, magnetic particles and biocides.

11. The imaged photographic element of claim 1 further comprising an antistatic layer superposed on the support.

12. The imaged photographic element of claim 1 further comprising a transparent magnetic layer superposed on the support.

13. The imaged photographic element of claim 1 further comprising wax particles selected from the group consisting of high density polyethylene, carnauba wax, and microcrystalline polyolefins.

14. A method of making a photographic element having a developed image comprising:

providing a photographic imaging element comprising a support and at least one silver halide emulsion layer superposed on a side of said support, imagewise exposing the photographic element to light;

developing the photographic imaging element in a photoprocessing solution;

applying a protective overcoat composition, overlying said silver halide emulsion layer, comprising a polycarbonate-containing polyurethane polymer having a $T_g$ of 0 to 70° C. and a molecular weight of 15,000 to 200,000, wherein the amount of polycarbonate, based on the total weight of the polymer, is at least 20 percent, wherein the overcoat composition is applied and dried at an average temperature of 50° C. to 70° C. during photoprocessing operation.

15. A method of making a recording element having a formed image comprising:

providing a recording element comprising a support, at least one ink or toner receiving layer and, forming an image on the receiving layer using an ink-jet or electrophotographic process to form an imaged element, applying a protective overcoat composition, overlying said silver halide emulsion layer, comprising a polycarbonate-containing polyurethane polymer having a $T_g$ of 0 to 70° C. and a molecular weight of 15,000 to 200,000, wherein the amount of polycarbonate, based on the total weight of the polymer, is at least 20 percent, wherein the overcoat composition is applied and dried at an average temperature of 40° C. to 75° C. and an residence time of from 30 seconds to 2.5 minutes.

16. A recording medium comprising:

(a) a support, (b) at least one receiving layer for absorbing a color forming ink or for receiving toner particles; and (c) an overcoat, overlying the receiving layer, comprising a polycarbonate-containing polyurethane polymer having a $T_g$ of 0 to 70° C. and a molecular weight of 15,000 to 200,000, wherein the amount of polycarbonate, based on the total weight of the polymer, is at least 20 percent.

17. The recording medium of claim 16 wherein component (b) comprises a hydrophilic polymer.

18. The recording medium of claim 16 wherein component (b) comprises a microporous material.

19. The recording medium of claim 16 for use in ink-jet printing further comprising at least one separate layer for retaining most of the carrier liquid for the ink.

* * * * *